United States Patent [19]

Evans

[11] 3,990,703

[45] Nov. 9, 1976

[54] TARGET HAVING RESILIENTLY DIVIDED COMPARTMENTS AND PROJECTILES

[76] Inventor: Maurice L. Evans, 6705 London Grove Port Road, Grove City, Ohio 43123

[22] Filed: Jan. 2, 1976

[21] Appl. No.: 646,305

[52] U.S. Cl. ..... 273/95 R; 273/105 R; 273/106 B

[51] Int. Cl.[2] ..... A63B 71/02

[58] Field of Search ..... 273/1 A, 26 R, 95 R, 273/95 E, 95 F, 102 R, 102 S, 105 R

[56] References Cited

UNITED STATES PATENTS

| | | | |
|---|---|---|---|
| 1,203,472 | 10/1916 | Branch | 273/95 R |
| 1,483,488 | 2/1924 | Skreberg | 273/95 R |
| 3,051,488 | 8/1962 | Villa | 273/105 R |
| 3,111,318 | 11/1963 | Northrup | 273/105 R |
| 3,345,068 | 10/1967 | Bowen | 273/1 A |
| 3,452,985 | 7/1969 | D'Zmura | 273/95 R |

*Primary Examiner*—Richard C. Pinkham
*Assistant Examiner*—Marvin Siskind
*Attorney, Agent, or Firm*—Robert K. Rhea

[57] ABSTRACT

A game apparatus including an upwardly open tray-like game board transversely partitioned to define compartments by a plurality of strands. A plurality of disk-like dice are each capable of being loosely received by the respective game board compartment and are individually tossed at the game board for obtaining a score in accordance with the value assigned to the respective game board compartment.

2 Claims, 2 Drawing Figures

TARGET HAVING RESILIENTLY DIVIDED COMPARTMENTS AND PROJECTILES

BACKGROUND OF THE INVENTION

1. Field of the Invention

The present invention relates to games and more particularly to a game of skill in tossing playing pieces toward an upwardly open compartmentalized game board.

Games of skill in which playing pieces are tossed toward a goal, such as horseshoes or endless rings tossed by the players toward a stake, are well known.

This invention provides a plurality of dice comprising disk-like members which are individually tossed toward an upwardly open compartmentalized game board with each of the compartments being assigned a score value for increasing the player's skill in attempting to toss the dice into a selected compartment.

SUMMARY OF THE INVENTION

A generally horizontally disposed rectangular tray-like game board, having upwardly diverging walls, is transversely and longitudinally divided by a plurality of strands extending between and connected with opposing walls to form a plurality of compartments within the game board. Each of the compartments are assigned a selected scoring value. A plurality of playing pieces, which are generally disk-shaped, are individually tossed by the players in turn toward a selected compartment of the game board.

The principal object of this invention is to provide a game apparatus for increasing the skill of players in tossing playing pieces toward a game board.

DESCRIPTION OF THE PREFERRED EMBODIMENT

Figure 1:
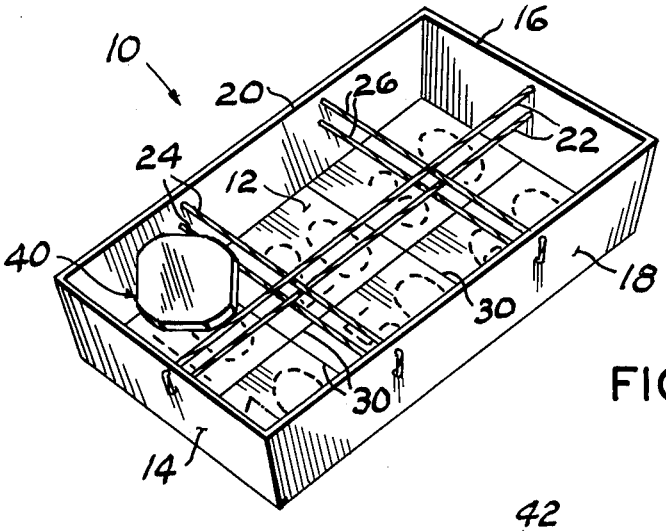
FIG. 1 is a perspective view of the game board having one of the playing pieces in one of its compartments; and, FIG. 2 is a perspective view of one of the playing pieces, per se.
Figure 2:
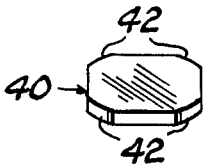

Like characters of reference designate like parts in those figures of the drawings in which they occur.

In the drawings:

The reference numeral 10 indicates the game board, as a whole, which is rectangular tray-like in general configuration. The game board comprises a horizontal bottom 12 integrally joined to end walls 14 and 16 and opposing side walls 18 and 20. The end and side walls are arranged in outwardly and upwardly diverging relation so that the area encompassed by the marginal upper edge limit of the end and side walls is slightly greater than the overall dimensions of the bottom 12. The game board is longitudinally divided medially its width by a pair of vertically spaced strands 22 extending through suitable apertures formed in the upper edge portion of the end walls 14 and 16. The game board is similarly transversely divided by two pairs of strands 24 and 26, respectively, extending through suitable apertures formed in the side walls 18 and 20 so that the spacing between the pair of strands 24 and the end wall 14 is substantially equal to one-third the length of the game board and similarly the spacing between the other pair of strands 26 and the end wall 16 is substantially equal to one-third the length of the game board.

The upper surface of the bottom 12 is provided with a plurality of scored lines 30 extending longitudinally and transversely of the tray parallel with the respective pairs of strands 22, 24 and 26. The scored lines, in combination with the respective pairs of strands, thus define a plurality, six in the example shown, of substantially square upwardly open compartments within the game board. Each of the compartments are assigned a numerical value by printing or scoring the upper surface of the bottom 12 with indicia designating the assigned value.

The numeral 40 indicates one of a plurality of identical sized playing pieces which is flat plate-like and square in general configuration having rounded or arcuate corner portions 42. The overall dimensions of the playing pieces 40 is selected in accordance with the dimensions of the game board and its compartments and is preferably such that the playing piece 40 may be freely received within any one of the compartments and so that a plurality of the playing pieces may be accommodated by any one of the compartments. A selected number of the playing pieces 40, comprising a "set", is assigned each player. The playing pieces of each set are all colored alike to contrast with the color of other sets of playing pieces.

Operation

In operation one or more of the game boards 10 are disposed at a selected location and a playing position, not shown, is selected spaced a predetermined distance from the game board. Any selected playing piece 40 of each set may be used by the several players who, by taking turns, toss individual ones of his set of the playing pieces toward a selected one of the upwardly open compartments. The purpose of the pairs of strands is to insure that the playing pieces enter or are completely disposed within one of the compartments to avoid a playing piece overlying the score lines on the game board bottom 12. Another purpose of the strands is to impart a resilient force against the playing piece so that, if inaccurately thrown, the resilience of the strands urges the playing piece toward the selected or a different compartment or over one of the game board boundry walls.

Scores added up determines the winner of the game.

Obviously the invention is susceptible to changes or alterations without defeating its practicability. Therefore, I do not wish to be confined to the preferred embodiment shown in the drawings and described herein.

I claim:

1. A game of skill, comprising:

an upwardly open horizontally disposed rectangular tray-like game board having integral outwardly and upwardly diverging walls;

partition means including flexible strands transversely and longitudinally dividing said game board to form a plurality of upwardly open compartments, said flexible strands comprise at least two strands disposed in vertically spaced superposed relation and connected at their respective ends with the respective game board wall intermediate its height; and, a plurality of playing pieces adapted to be tossed toward said game board and loosely received within the respective compartment.

2. The game of skill according to claim 1 in which said playing pieces each comprise a flat disk-like member.

* * * * *